US006076509A

United States Patent [19]

Kyuma

[11] Patent Number: 6,076,509

[45] **Date of Patent: *Jun. 20, 2000**

[54] FUEL SUPPLY APPARATUS OF OUTBOARD MOTOR

[75] Inventor: Katsunori Kyuma, Hamamatsu, Japan

[73] Assignee: Suzuki Kabushiki Kaisha, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/030,855

[22] Filed: Feb. 26, 1998

[30] Foreign Application Priority Data

Feb. 27, 1997 [JP] Japan ..... 9-044231

[51] Int. Cl.[7] ..... F02M 37/04

[52] U.S. Cl. ..... 123/516; 123/179.11

[58] Field of Search ..... 123/516, 519, 123/520, 521, 518, 179.11

[56] References Cited

U.S. PATENT DOCUMENTS

| | | | |
|---|---|---|---|
| 3,978,839 | 9/1976 | DuBois | 123/179.11 |
| 4,373,479 | 2/1983 | Billingsley | 123/179.11 |
| 5,119,790 | 6/1992 | Olson | 123/516 |
| 5,309,885 | 5/1994 | Rawlings | 123/516 |
| 5,313,978 | 5/1994 | Takaki | 123/516 |
| 5,335,638 | 8/1994 | Mukai | 123/516 |
| 5,450,831 | 9/1995 | Fukuoka | 123/516 |
| 5,598,827 | 2/1997 | Kato | 123/516 |
| 5,797,378 | 8/1998 | Kato | 123/516 |

*Primary Examiner*—Carl S. Miller

*Attorney, Agent, or Firm*—Finnegan, Henderson, Farabow, Garrett & Dunner, L.L.P.

[57] ABSTRACT

A fuel supply apparatus of an outboard motor for supplyng an air to an engine of the outboard motor comprises a vapor separator for removing bubbles in the a fuel, a float-type bubble discharge valve which is provided for the vapor separator and adapted to be closed when a fuel level in a fuel tank rises, and a negative-pressure-opening type valve connected to a downstream side of the bubble discharge valve so as to be opened upon reception of an intake negative pressure of then engine. A valve opening pressure of the negative-pressure-opening type valve is set to a value lower than a pressure of a squeeze pump, connected to a fuel tank, required for pumping a fuel therefrom.

6 Claims, 4 Drawing Sheets

FUEL SUPPLY APPARATUS OF OUTBOARD MOTOR

BACKGROUND OF THE INVENTION

The present invention relates to a fuel supply apparatus of an outboard motor.

A fuel supply apparatus for supplying a fuel to an engine of an outboard motor is provided with a vapor separator for removing bubbles in the fuel. The vapor separator is formed into a shape of a small tank and is provided at its upper portion with a bubble discharge valve, which is designed to be closed by utilizing a buoyancy of a float.

Bubbles included in a fuel rise to the fuel surface level in the vapor separator and are discharged from the bubble discharge valve into an intake passage or the like. If the fuel level rises in the vapor separator, the float rises and the bubble discharge valve is closed. Therefore, in a normal condition, because only the bubbles are discharged from the bubble discharge valve and the fuel itself does not flow out easily.

However, in a case where a fuel tank mounted in a body of a boat, i.e. hull, is disposed on a position higher than the location of the vapor separator, when the engine is stopped, the fuel level rises in the vapor separator simultaneously, and there is a possibility that a fuel may overflow from the bubble discharge valve.

In order to prevent such an inconvenience, it is necessary to extremely enhance a fabrication accuracy of the bubble discharge valve of the vapor separator, and to increase a size of the float which closes the bubble discharge valve so as to increase the buoyancy so that the properties for cutting of fuel when the bubble discharge valve is closed is enhanced. However, these measures increase the fabrication cost of the vapor separator, and a size of the vapor separator is unintentionally increased.

Alternatively, if a cock which is manually opened and closed is provided at downstream of the vapor discharge valve of the vapor separator so as to close the cock when the engine is stopped in operation, it is possible to prevent the overflow of fuel even if the properties for cutting of fuel of the bubble discharge valve may be deteriorated in some degrees. However, there are drawbacks that the manual opening and closing operations of the cock are troublesome, and if the cock is closed when the engine is started, a fuel can not be supplied from the fuel tank by a squeeze pump (manual compressor) or air in the vapor separator can not be removed.

SUMMARY OF THE INVENTION

An object of the present invention is to substantially eliminate defects or drawbacks encountered in the prior art described above and to provide a fuel supply apparatus for an outboard motor capable of preventing a fuel from overflowing from a vapor separator when the engine is stopped, even if a low priced and small sized vapor separator is used.

Another object of the present invention is to provide a fuel supply apparatus for an outboard motor capable of supplying a fuel by a location of a squeeze pump and removing air in the vapor separator when the engine is started.

These and other objects can be achieved according to the present invention by providing a fuel supply apparatus of an outboard motor for supplying an air to an engine of the outboard motor, which comprises a vapor separator for removing bubbles in the a fuel and a float-type bubble discharge valve which is provided for the vapor separator and adapted to be closed when a fuel level in a fuel tank rises, wherein a negative-pressure-opening type valve is connected to a downstream side of the bubble discharge valve and adapted to be opened upon reception of an intake negative pressure of the engine.

In more detailed structure, there is provided a fuel supply apparatus of an outboard motor for supplying an air to an engine of the outboard motor from a fuel tank through a fuel supply passage, comprising:

- a fuel filter disposed on a way of the fuel supply passage;
- a low pressure pump unit disposed on the way of the fuel supply passage;
- a vapor separator for removing bubbles in the fuel;
- a float-type bubble discharge valve which is provided for the vapor separator and adapted to be closed when a fuel level in a fuel tank rises;
- a high pressure pump unit disposed on the way of the fuel supply passage; and
- a negative-pressure-opening type valve connected to a downstream side of the bubble discharge valve and adapted to be opened upon reception of an intake negative pressure of the engine.

In preferred embodiment, the negative-pressure-opening type valve has a valve opening pressure set to a value lower than a pressure of a squeeze pump, connected to the fuel tank, required for pumping a fuel from the fuel tank.

A surge tank is disposed in the outboard motor and the negative-pressure-opening type valve is disposed to an upper surface of the surge tank in a state of the outboard motor mounted to a hull. The vapor separator and a pressure regulator are disposed on one side of the surge tank, and a delivery pipe is disposed on the one side of the surge tank so as to extend perpendicularly and a plurality of injectors are mounted to the delivery pipe.

The vapor separator is composed of a separator body in form of a tank, a fuel passage which is integrally formed with the separator body and through which the fuel is introduced into the separator body, and a fuel discharge passage which is integrally formed with the separator body and through which the fuel is discharged, and the bubble discharge valve is disposed in the fuel discharge passage, which is operatively connected to the negative-pressure-opening type valve.

According to the structure of the fuel supply apparatus of an outboard motor of the present invention mentioned above, when the engine is stopped, an intake negative pressure of the engine is simultaneously prevented from acting on the negative-pressure-opening type valve connected downstream of the bubble discharge valve, and the negative-pressure-opening type valve is closed. Therefore, the fuel level in the vapor separator is prevented from rising, and the fuel is also prevented from overflowing from the bubble discharge valve. Even if the fuel should leak from the bubble discharge valve, the leak fuel does not flow downstream of the closed negative-pressure-opening type valve.

Furthermore, it is not necessary to extremely enhance a fabrication accuracy of the bubble discharge valve of the vapor separator and to increase a size of the float so as to enhance the properties for cutting of fuel of the bubble discharge valve. It is also possible to effectively prevent the fuel from overflowing from the vapor separator when the engine is stopped, even if a low priced and small sized vapor separator is used.

Furthermore, if a valve opening pressure of the negative-pressure-opening type valve is set to a value lower than a pressure of a squeeze pump required for pumping fuel from the fuel tank, because the negative-pressure-opening type valve can be opened by the pressure of the squeeze pump, it is possible to supply a fuel by the squeeze pump and to remove air in the vapor separator when the engine is started.

The nature and further characteristic features of the present invention will be made more clear from the following descriptions made with reference to the accompanying drawings.

DESCRIPTION OF THE PREFERRED EMBODIMENT

An embodiment of the present invention will be described hereunder with reference to the accompanying drawings.

Figure 1:
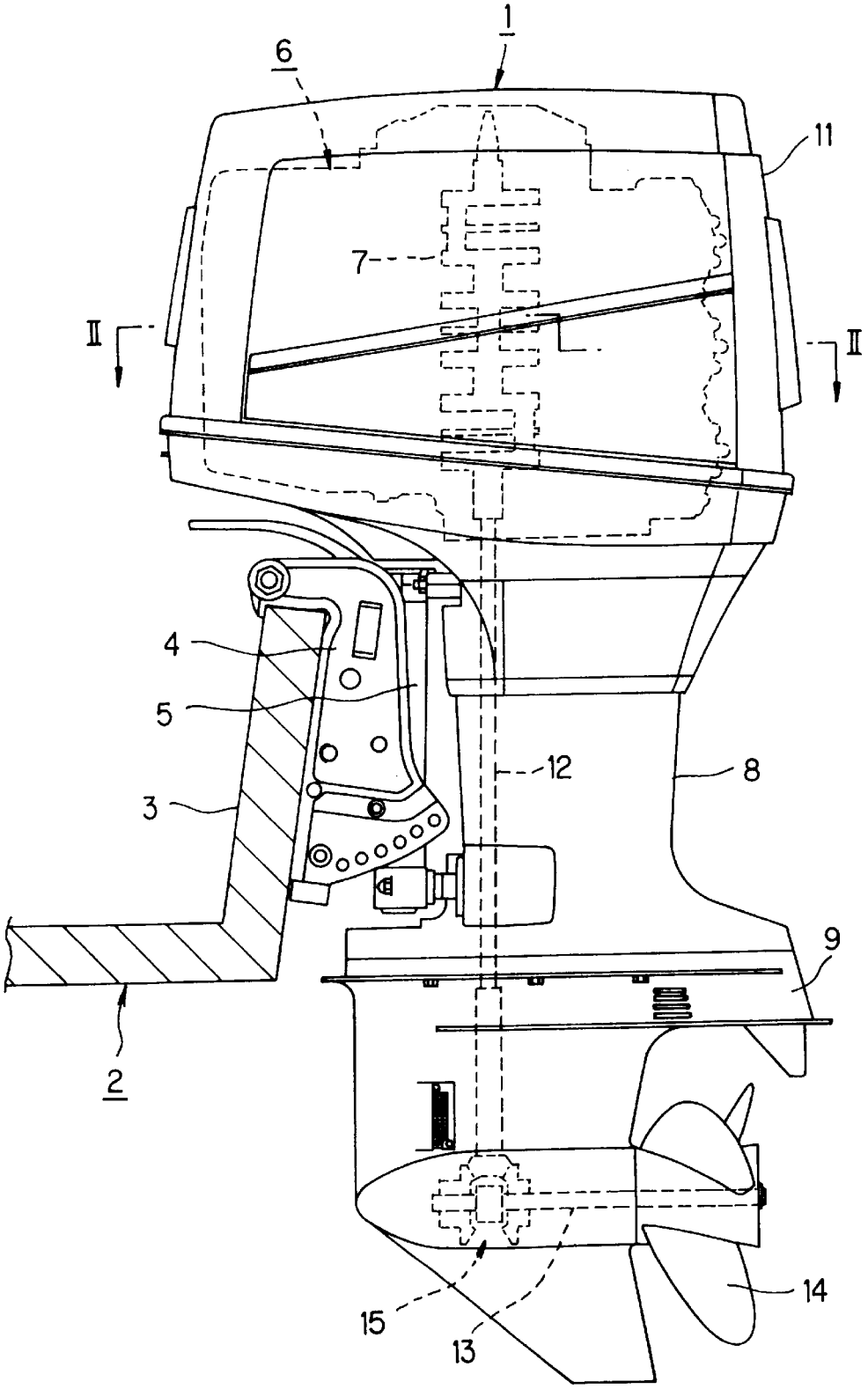
FIG. 1 is a left side view showing one example of an outboard motor, in a state mounted to a hull, to which a fuel supply apparatus of the present invention is applied.
Figure 2:
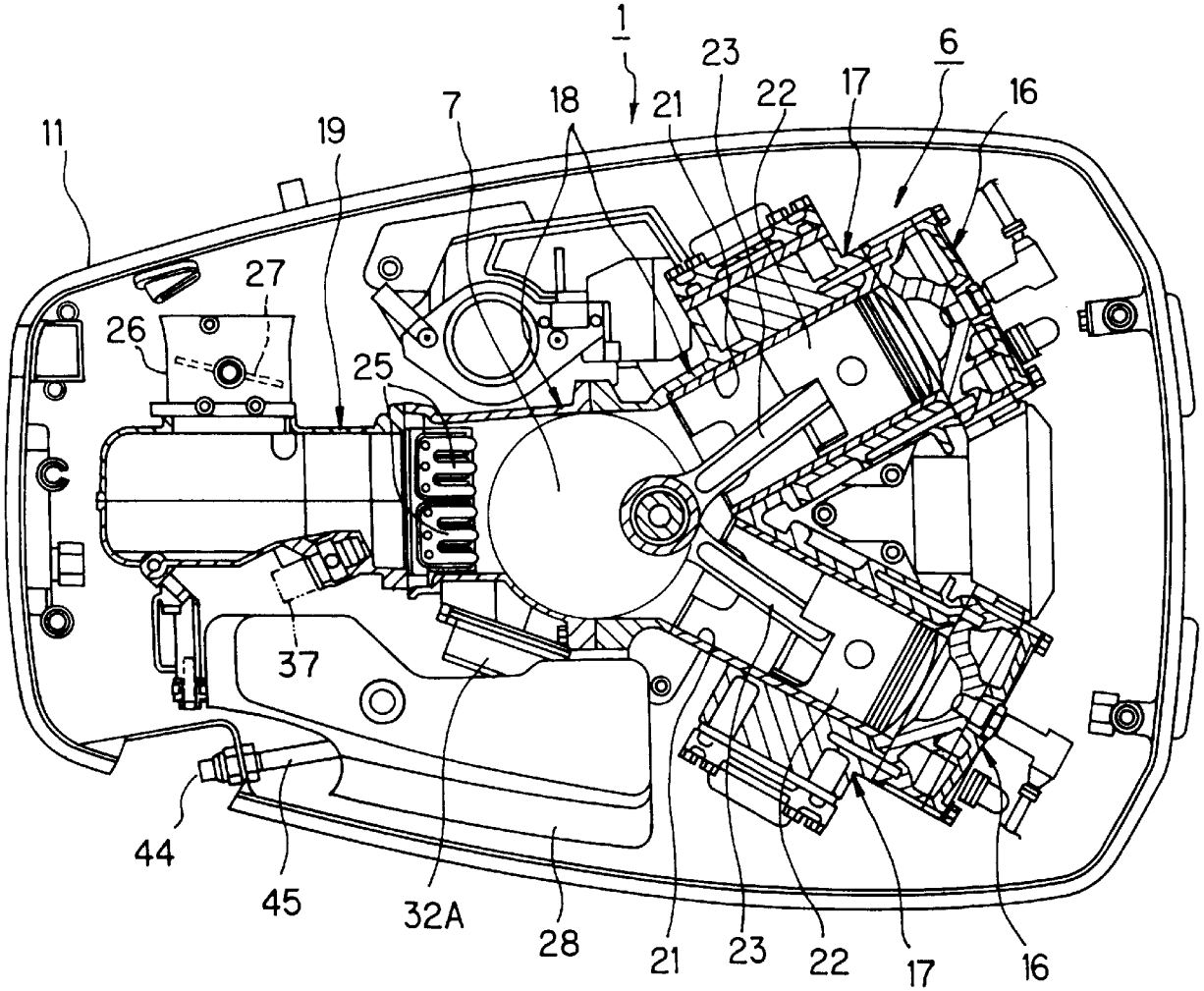
FIG. 2 is a transverse sectional view of an engine portion taken along the line II—II in FIG. 1.

Referring to FIGS. 1 and 2, an outboard motor 1 is mounted to a transom 3 of a body (hull) 2 of a boat through a clamp bracket 4 to be turnable in a lateral direction around a pilot shaft 5 which is vertically mounted to a rear portion of the clamp bracket 4.

An engine 6 mounted on an uppermost portion of the outboard motor 1 is, for example, a water-cooled two-stroke-cycle V-shaped six-cylinder engine, in which six cylinders are arranged so as to provide a V-shape arrangement, and is vertically mounted so that a crankshaft 7 of the engine 6 is directed in a vertical direction. A drive shaft housing 8 and a gear housing 9 are continuously fixed to lower portions of the engine 6, and the engine 6 is covered with an engine cover 11 which may be divided into upper and lower halves.

A drive shaft 12 extending downward is connected to a lower end of the crankshaft 7 of the engine 6 such that the drive shaft 12 rotates in unison with the crankshaft 7. The drive shaft 12 extends through the drive shaft housing 8 and reaches the inside of the gear housing 9.

A propeller shaft 13 extending in a longitudinal direction of the hull is pivotally supported in the gear housing 9 and is provided at its rear end with a propeller 14 which rotates in association with the propeller shaft 13. The rotation of the drive shaft 12 is transmitted to the propeller shaft 13 by a bevel gear mechanism 15 provided on a point of intersection between the drive shaft 12 and the propeller shaft 13, so that the propeller 14 is driven for rotation.

The engine 6 comprises cylinder heads 16, cylinder blocks 17, a crankcase 18, a surge tank 19 and the like. The crankshaft 7 is pivotally supported in the crankcase 18. The cylinder blocks 17 are provided in pair at right and left sides so as to form a V-shape as viewing on a plane. Each of the cylinder blocks 17 is formed with three cylinder bores 21, and six, in total, pistons 22 inserted in the respective cylinder bores 21 are connected to the crankshaft 7 through connecting rods 23.

A lead valve 25 is provided at a junction between the crankcase 18 and the surge tank 19, and a throttle body 26 is disposed on a right side of the surge tank 19. Provided in the throttle body 26 is a butterfly-type throttle valve 27 which is for adjusting an intake air amount. An oil tank 28 is disposed on the left side of the surge tank 19.

Figure 3:
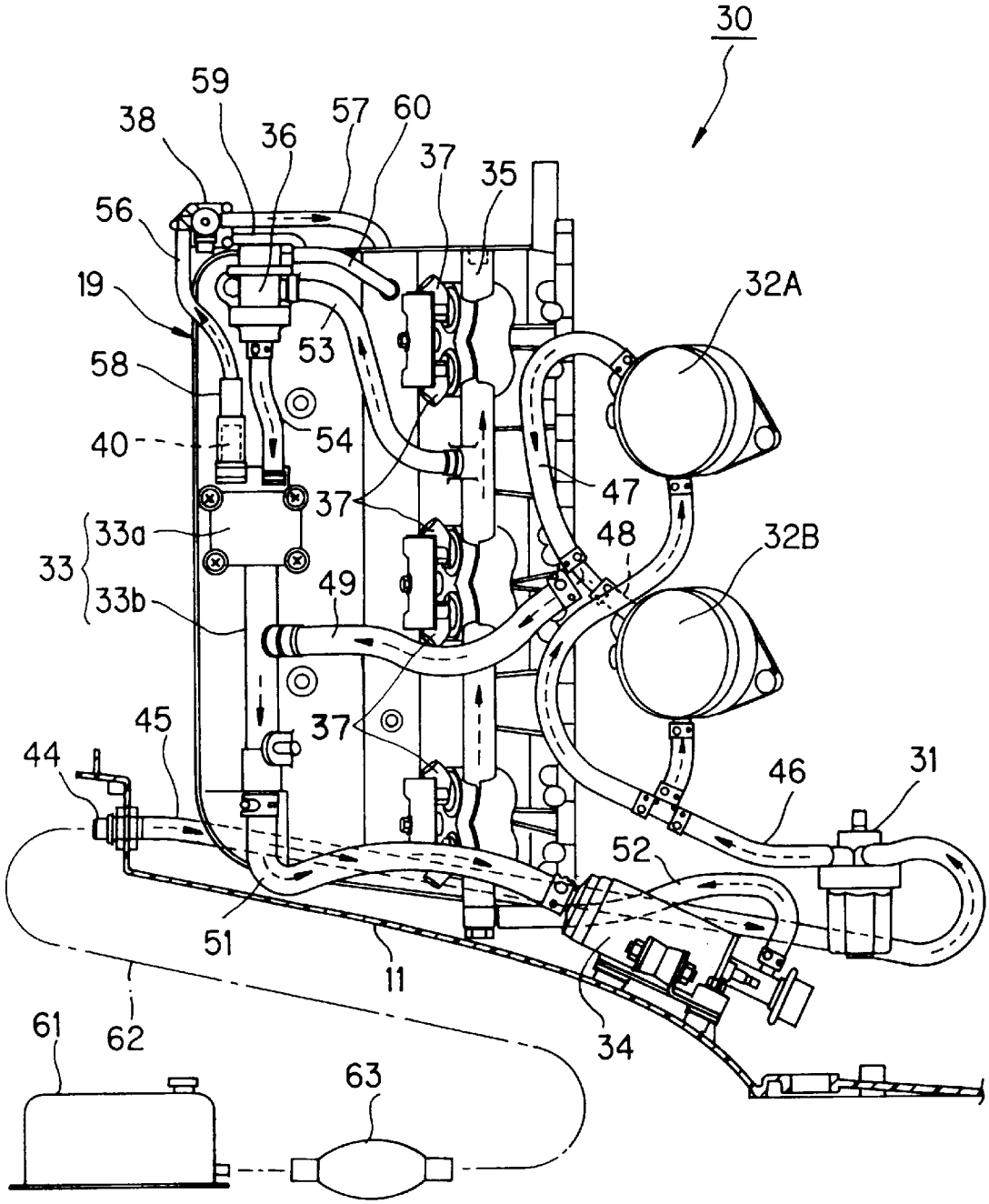
FIG. 3 is an enlarged left side view of a portion around a surge tank, showing one embodiment of the fuel supply apparatus according to the present invention.

FIG. 3 is an enlarged left side view of a portion around the surge tank 19, representing the embodiment of the fuel supply apparatus 30 according to the present invention.

The fuel supply apparatus 30 comprises a fuel filter 31, two low-pressure pumps 32A and 32B, a vapor separator 33, a high-pressure pump 34 (which has a pumping pressure higher than that of the lower pressure pumps 32A, 32B), a delivery pipe 35, a pressure regulator 36, six injectors 37 and a negative-pressure-opening type valve 38, which are located on the way of the fuel supply passage between the fuel tank and the engine.

For example, the fuel filter 31 and the low-pressure pumps 32A and 32B are provided on a left side of the cylinder block 17, and the vapor separator 33 and the pressure regulator 36 are provided on a left side of the surge tank 19. The high-pressure pump 34 is provided on a bottom of the engine cover 11, and a negative-pressure-opening type valve 38, which is opened in response to negative pressure, is provided on an upper surface of the surge tank 19.

The delivery pipe 35 is formed so as to extend in a vertical direction along the left side of the surge tank 19, and the six injectors 37 are mounted to the delivery pipe 35. Each of the injectors 37 is disposed to incline inward to direct toward the lead valve 25.

Figure 4:
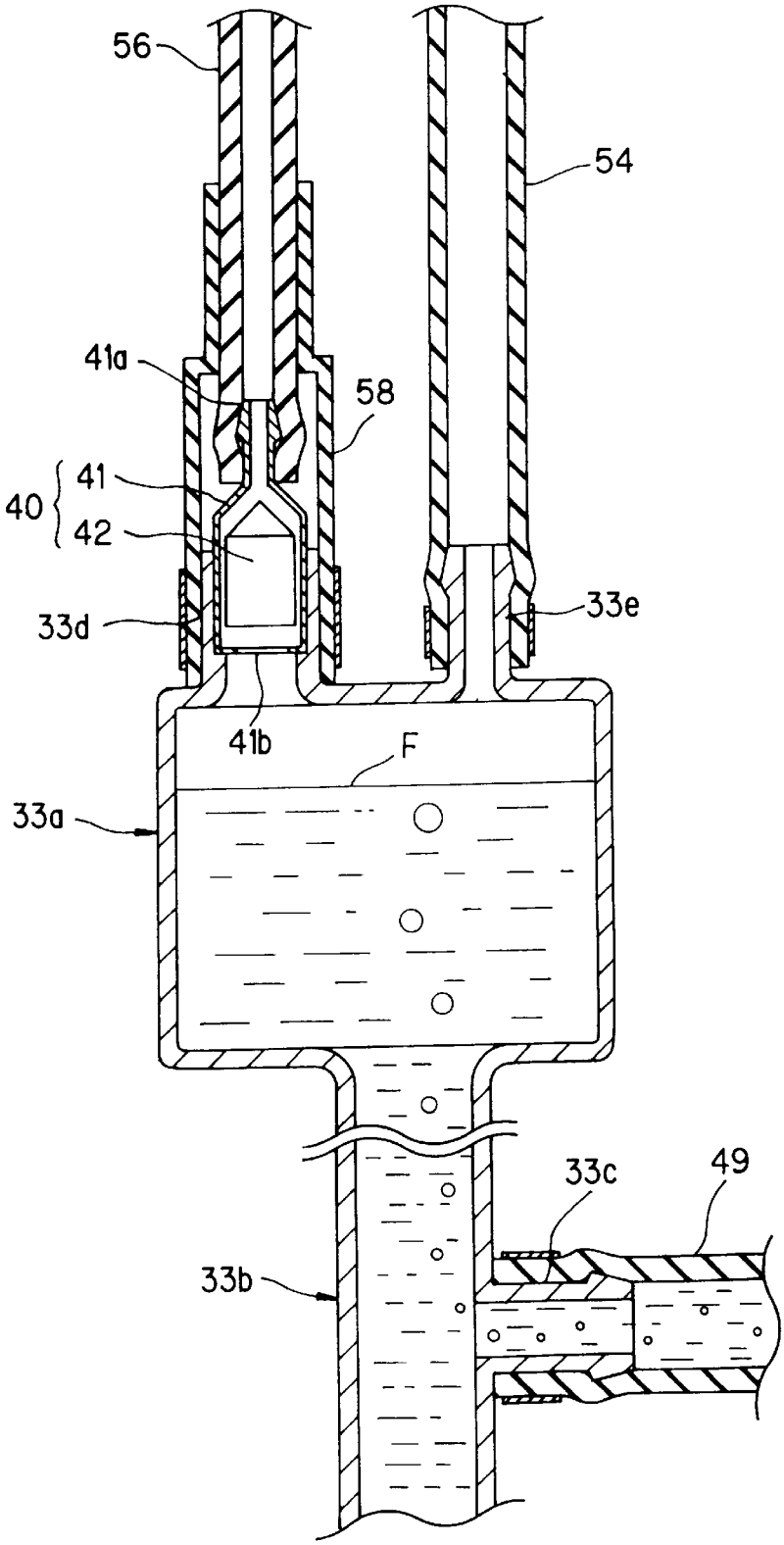
FIG. 4 is an enlarged longitudinal sectional view of a vapor separator.

As shown in FIG. 4, the vapor separator 33 comprises a separator body 33*a* formed into a small square tank-shape, and a pipe-shaped fuel passage 33*b* which extends downward from a lower surface of the separator body 33*a* and is integrally formed therewith. A union 33*c* is formed at an intermediate portion of the fuel passage 33*b*. The separator body 33*a* is provided at its upper surface with two kinds of unions 33*d* and 33*e* having different diameters. The union 33*d* having a larger diameter is provided with a float-type bubble discharge valve 40 disposed therein.

The bubble discharge valve 40 comprises a float housing 41 which is formed into a substantially cylindrical shape and which is formed at its upper portion with a nipple 41*a* for connection with a hose and also comprises a float valve 42 which is accommodated in the float housing 41 and which is vertically movable. The float housing 41 is fixed to the union 33*d* of the separator body 33*a* by press-fitting or the like. An upper end of the float valve 42 is formed into a conical shape capable of closing or occluding the nipple 41*a*. The float housing 41 is provided with a stopper 41*b* for preventing the float valve 42 from loosing out or dropping.

As shown in FIGS. 2 and 3, a fuel supply union 44 is provided on a lower left side of the engine cover 11. The fuel supply union 44 and the fuel filter 31 are operatively connected through a fuel hose 45. Further, another fuel hose 46 is connected to the fuel filter 31, and the other end of the fuel hose 46 is bifurcated, and the bifurcations are connected to intake sides of the low-pressure pumps 32A and 32B, respectively.

Fuel hoses 47 and 48 are extending from discharging sides of the low-pressure pumps 32A and 32B, respectively, and these hoses 47 and 48 are joined into one fuel hose 49 which is connected to the union 33*c* of the vapor separator 33 (fuel passage 33*b*). Because the two low-pressure pumps 32A and 32B are connected in parallel in this manner, even if one of the low-pressure pumps 32A and 32B should have trouble, a fuel is supplied by the other one of the low-pressure pumps.

Further, the other end of the fuel hose 51 extending from a lower end of the fuel passage 33*b* of the vapor separator 33 is connected to the intake side of the high-pressure pump 34, and a fuel hose 52 extending from the discharging side of the high-pressure pump 34 is connected to a lower end of the delivery pipe 35.

A fuel hose 53 extends from an intermediate portion of the delivery pipe 35, and the other end of the fuel hose 53 is connected to the pressure regulator 36. A fuel hose 54 extending downward from the pressure regulator 36 is connected to the union 33 of smaller diameter of the vapor separator 33 (separator body 33*a*).

The bubble discharge valve 40 (nipple 41*d*) of the vapor separator 33 and the negative-pressure-opening type valve 38 are connected through a first bubble discharge hose 56. The negative-pressure-opening type valve 38 and the surge tank 19 are connected through a second bubble discharge hose 57. That is, the negative-pressure-opening type valve 38 is connected downstream of the bubble discharge valve 40. A waterproof boot 58 is provided around the bubble discharge valve 40.

A negative pressure hose 59 is connected to the negative-pressure-opening type valve 38, and the other end of the negative pressure hose 59 is connected to an upper surface of the surge tank 19 and the like. When the engine 6 is operated, an intake negative pressure generated in the surge tank 19 acts on the negative-pressure-opening type valve 38 through the negative pressure hose 59 to open the negative-pressure-opening type valve 38.

Further, the pressure regulator 36 is also fabricated to open upon reception of a negative pressure in the surge tank 19. The pressure regulator 36 and the surge tank 19 are connected through a negative pressure hose 60. Alternatively, it is also possible to integrally provide the surge tank 19 with the negative-pressure-opening type valve 38 and the pressure regulator 36, thereby omitting the negative pressure hoses 59 and 60.

As shown in FIG. 3, the fuel supply union 44 and the fuel tank 61 mounted outside (body 2) the outboard motor 1 are connected through an external hose 62, and a squeeze pump (manual compressor) 63 is provided at an intermediate portion of the external hose 62. If the squeeze pump 63 is manually squeezed, a fuel in the fuel tank 61 is supplied toward the fuel supply apparatus 30.

A valve opening pressure of the negative-pressure-opening type valve 38 is set to a value lower than a pressure of the squeeze pump 63. For example, if the pressure of the squeeze pump 63 is set to 1 to 1.5 kg/cm$^2$, the valve opening pressure of the negative-pressure-opening type valve 38 is set to about 0.3 to 0.5 kg/cm$^2$.

The fuel supply apparatus 30 is fabricated as described above. A fuel in the fuel tank 61 is flowed through the external hose 62 and the fuel hose 45, is filtered by the fuel filter 31, and then, pumped into the two low-pressure pumps 32A and 32B. The fuel discharged from each of the low-pressure pumps 32A and 32B is flowed through the fuel passage 33*b* of the vapor separator 33 and the fuel hose 51 and is pumped into the high-pressure pump 34. The high pressure fuel discharged from the high-pressure pump 34 is flowed through the fuel hose 52 into the delivery pipe 35 and ejected toward the lead valve 25 by the injector 37. Excessive fuel in the delivery pipe 35 is fed to the pressure regulator 36 through the fuel hose 53, is reduced in pressure in the pressure regulator 36, and then, returned to the vapor separator 33. Many bubbles are included in a fuel flowing into the fuel passage 33*b* of the vapor separator 33 from the low-pressure pumps 32A and 32B. These bubbles rise in the fuel passage 33*b* and rise to the fuel level F of the separator body 33*a* as shown in FIG. 4.

When the engine 6 is operated, because an intake negative pressure in the surge tank 19 acts on the negative-pressure-opening type valve 38 and thus the valve 38 is opened, bubbles which have risen to the fuel level F in the separator body 33*a* are discharged through the bubble discharge valve 40, and then, sent into the surge tank 19 through the first bubble discharge hose 56, the negative-pressure-opening type valve 38 and the second bubble discharge hose 57 in this order.

If the fuel level F in the separator body 33*a* rises and reaches the height of the float valve 42, because the float valve 42 is pushed up and the bubble discharge valve 40 is closed, the fuel itself does not flow out through the bubble discharge valve 40. Even if the fuel leaks from the bubble discharge valve 40, only a little amount of leak fuel is fed to the surge tank 19 and is drawn into the engine 6, which will cause no problem.

When the engine 6 is stopped, because the intake negative pressure does not act on the negative-pressure-opening valve 38 any more, and hence, it is closed. Therefore, the fuel level F in the separator body 33*a* is prevented from rising, and the fuel from the bubble discharge valve 40 is also prevented from overflowing. Even if a fuel should leak from the bubble discharge valve 40, such leak fuel does not flow downstream of the negative-pressure-opening type valve 38 which is now closed and thus, the fuel is prevented from leaking into the surge tank 19.

Therefore, according to the fuel supply apparatus 30, it is unnecessary to extremely enhance a fabrication accuracy of the bubble discharge valve 40 and to enhance the properties for cutting of fuel of the bubble discharge valve 40 by providing a large float. It is also possible to effectively prevent a fuel from overflowing from the vapor separator when the engine 6 is stopped, even if the design of the bubble discharge valve 40 is very simple, and the low priced and small sized vapor separator 33 is usable.

Further, because the valve opening pressure of the negative-pressure-opening type valve 38 is set lower than the pressure of the squeeze pump 63, even when the engine 6 is stopped and the valve 38 is closed, it is possible to open the valve 38 by manually squeezing the squeeze pump 63. Therefore, although the negative-pressure-opening type valve 38 is provided, a fuel can be fed by the squeeze pump 63 and air in the vapor separator 33 can be removed when the engine 6 is started.

As explained above, in the fuel supply apparatus for an outboard motor according to the present invention, the negative-pressure-opening type valve 38 which opens upon reception of an intake negative pressure of the engine is connected downstream of the bubble discharge valve of the vapor separator 33 which remove bubbles in fuel. Therefore, it is not necessary to extremely enhance a fabrication accuracy of the bubble discharge valve 40 and to enhance the properties for cutting of fuel of the bubble discharge valve 40 by providing a large float. It is also possible to effectively prevent a fuel from overflowing from the vapor separator 33 when the engine 6 is stopped, even if the design of the bubble discharge valve 40 is very simple, and the low priced and small sized vapor separator 33 is usable.

Further, in the fuel supply apparatus of the present invention, because the valve opening pressure of the negative-pressure-opening type valve 38 is set lower than the pressure of the squeeze pump 63, a fuel can be fed by the squeeze pump 63 and air in the vapor separator 33 can be removed when the engine is started.

It is to be noted that the present invention is not limited to the described embodiment and many other change and modifications may be made without departing from the scope of the appended claims.

What is claimed is:

1. A fuel supply apparatus of an outboard motor for supplying fuel to an engine of the outboard motor from a fuel tank through a fuel supply passage, comprising:

the fuel tank in one-way fluid connection with the fuel supply passage, wherein the fuel supply passage includes a closed fuel feed loop portion;

a fuel filter disposed along the fuel supply passage, a low pressure pump unit disposed along the fuel supply passage;

a vapor separator for removing vapor bubbles in the fuel in the closed fuel feed loop portion and fluidly connected to the low pressure pump;

a bubble discharge valve having a float, defining a vapor outlet for the vapor separator, and adapted to close when a fuel level in the vapor separator rises;

a high pressure pump unit disposed within the closed fuel feed loop portion of the fuel supply passage; and a negative-pressure-opening type valve fluidly connected to a downstream side of the bubble discharge valve and adapted to open responsive to an intake negative pressure of the engine to discharge the vapor from the vapor separator.

2. A fuel supply apparatus of an outboard motor according to claim 1, wherein said negative-pressure-opening type valve is adapted to open responsive to a value of pressure lower than a priming value of pressure generated by a squeeze pump connected to the fuel tank for pumping fuel from the fuel tank.

3. A fuel supply apparatus of an outboard motor according to claim 1, wherein a surge tank is disposed on the outboard motor and said negative-pressure-opening type valve is disposed adjacent to an upper surface of the surge tank, within the outboard motor.

4. A fuel supply apparatus of an outboard motor according to claim 3, wherein said vapor separator and a pressure regulator are disposed on one side of the surge tank.

5. A fuel supply apparatus of an outboard motor according to claim 4, wherein a delivery pipe is disposed on the one side of the surge tank and a plurality of injectors extend from the delivery pipe.

6. A fuel supply apparatus of an outboard motor according to claim 1, wherein said vapor separator further comprises: a separator body defining a tank, a fuel passage integrally formed with the separator body for introducing fuel into the separator body, and a fuel vapor discharge passage integrally formed with the separator body for discharging fuel vapor; and wherein said bubble discharge valve is disposed in the fuel vapor discharge passage and is operatively connected to said negative-pressure-opening type valve.

* * * * *

UNITED STATES PATENT AND TRADEMARK OFFICE

CERTIFICATE OF CORRECTION

PATENT NO. : 6,076,509
DATED : June 20, 2000
INVENTOR : Katsunori KYUMA

It is certified that error appears in the above-identified patent and that said Letters Patent is hereby corrected as shown below:

On the Title Page, Item [57], in the Abstract, line 1, "supplyng" should read --supplying--.

On the Title Page, Item [57], in the Abstract, line 3, before "a fuel", delete "the".

On the Title Page, Item [57], in the Abstract, line 9, "then engine" should read --the engine--.

In Claim 1, column 7, line 14, "passage," should read --passage;--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*